US009474666B1

(12) United States Patent
Smith

(10) Patent No.: US 9,474,666 B1
(45) Date of Patent: Oct. 25, 2016

(54) SPRING LOADED INTERCHANGEABLE WHEELCHAIR LEG

(71) Applicant: Robert Smith, Hinsdale, NY (US)

(72) Inventor: Robert Smith, Hinsdale, NY (US)

( * ) Notice: Subject to any disclaimer, the term of this patent is extended or adjusted under 35 U.S.C. 154(b) by 140 days.

(21) Appl. No.: 14/321,319

(22) Filed: Jul. 1, 2014

(51) Int. Cl.
*A61G 5/12* (2006.01)
*A61G 5/10* (2006.01)

(52) U.S. Cl.
CPC . *A61G 5/10* (2013.01); *A61G 5/12* (2013.01); *A61G 2005/127* (2013.01); *A61G 2005/128* (2013.01); *Y10T 403/32819* (2015.01)

(58) Field of Classification Search
CPC .... A61G 5/023; A61G 5/025; A61G 5/1056; A61G 5/12; A61G 2005/128; A61G 2005/1051; A61G 2005/127; Y10T 403/32819
See application file for complete search history.

(56) References Cited

U.S. PATENT DOCUMENTS

| | | | | | |
|---|---|---|---|---|---|
| 2,718,396 | A | | 9/1955 | Lateau et al. | |
| 2,793,682 | A | | 5/1957 | Duke | |
| 3,072,437 | A | * | 1/1963 | Shea | A61G 5/12 297/423.32 |
| 3,189,385 | A | * | 6/1965 | Mommsen | A61G 5/12 188/DIG. 2 |
| 3,618,968 | A | * | 11/1971 | Greer | A61G 5/006 280/211 |
| 4,635,999 | A | * | 1/1987 | Simpson | B60N 2/4495 297/328 |
| 5,033,793 | A | * | 7/1991 | Quintile | A61G 5/12 297/423.33 |
| 5,328,247 | A | * | 7/1994 | Lovins | A47C 7/506 297/423.3 |
| 5,522,644 | A | * | 6/1996 | Peek | A47C 7/503 297/423.26 |
| 5,722,922 | A | | 3/1998 | Watterson et al. | |
| 5,772,559 | A | | 6/1998 | Sithole | |
| 6,142,914 | A | | 11/2000 | Crawford et al. | |
| 6,334,624 | B1 | | 1/2002 | Giglio | |
| 6,585,279 | B1 | | 7/2003 | Galloway et al. | |
| D484,930 | S | | 1/2004 | Yang | |
| 6,880,845 | B1 | | 4/2005 | Broyles et al. | |
| 7,008,357 | B2 | | 3/2006 | Winkler | |
| 7,360,840 | B2 | | 4/2008 | Barlow et al. | |
| 7,540,520 | B2 | | 6/2009 | Barlow et al. | |
| 7,569,002 | B2 | | 8/2009 | Nativ | |
| 8,187,156 | B2 | | 5/2012 | Hochberg et al. | |
| 8,469,866 | B2 | | 6/2013 | Hochberg et al. | |
| 8,628,104 | B1 | * | 1/2014 | Stare | A61G 5/10 280/304.1 |
| 2002/0101054 | A1 | * | 8/2002 | James | A61G 5/023 280/250.1 |
| 2003/0075967 | A1 | * | 4/2003 | Ciolfe | A61G 5/12 297/423.32 |
| 2003/0130093 | A1 | | 7/2003 | Giglio | |
| 2005/0212255 | A1 | * | 9/2005 | Jansen | A61G 5/12 280/304.1 |
| 2008/0269026 | A1 | | 10/2008 | Tsadok | |

FOREIGN PATENT DOCUMENTS

| | | | | | |
|---|---|---|---|---|---|
| GB | 2089204 | A | * | 6/1982 | A61G 5/12 |

* cited by examiner

*Primary Examiner* — Joseph Rocca
*Assistant Examiner* — Daniel Yeagley
(74) *Attorney, Agent, or Firm* — Simpson & Simpson, PLLC

(57) ABSTRACT

A wheelchair leg arranged to be attached to a frame of a wheelchair comprising a first member, a bracket secured to the first member and operatively arranged to attach the first member to the frame, a second member pivotably attached to the first member, a third member arranged in telescoping engagement with the second member, and a spring located between the second member and the third member and operatively arranged to provide tension between the second and third members when the third member is moved relative to the second member.

16 Claims, 9 Drawing Sheets

SPRING LOADED INTERCHANGEABLE WHEELCHAIR LEG

FIELD OF INVENTION

The invention relates to a wheelchair and, more specifically, to a wheelchair leg and, even more specifically, to a spring-loaded interchangeable wheelchair leg used to convert a wheelchair for use in physical therapy or exercise.

BACKGROUND OF THE INVENTION

The wheelchair has continued to be an ever evolving mode of transportation for the elderly, injured and disabled. The wheelchair traces its roots back to the $5^{th}$ century, where a Greek vase displays an image of a wheeled bed. In the late $16^{th}$ century, King Phillip II of Spain was provided a chair with wheels in his later years. However, the introduction of what has come to be known as the "modern" wheelchair arguably evolved from the invention of the bicycle.

FIG. 1 is a perspective view of typical wheelchair assembly 100. In FIG. 1, an individual 150 is shown in a seated position in typical wheelchair assembly 100. Wheelchair assembly 100 generally includes frame 101, seat 102, backrest 103, armrest 104, first leg 105 and a second leg (not shown), front wheels 108 and 109 (not shown), and rear wheels 110 and 111. It should be appreciated that first leg 105 and the second leg (not shown) are structurally similar. The rear wheels 110 and 111 are attached to the rear of frame 101 of wheelchair assembly 100. The front wheels 108 and 109 are attached to the front of frame 101 of wheelchair assembly 100. Leg 105 further includes first member 112, second member 113 and third member 114. First and second members 112 and 113, respectively, are connected by bolt 115 and third member 114, which lies perpendicularly to second member 113, further connecting first member 112 with second member 113. Second member 113 is further secured to frame 101 of wheelchair assembly 100 by bolts 116 and 118, respectively. First leg 105 the and second leg (not shown) further include first and second footrests 119 and 120, respectively. The individual is shown sitting in seat 102, with back 151 placed against backrest 103 and right arm 152 placed on right armrest 104. The individual's legs 153 and 154 are bent at approximately a 90 degree angle, with right foot 155 placed on right footrest 119 and left foot 156 placed on left footrest 120 of wheelchair assembly 100.

Today, the "modern" wheelchair continues to be modified as a means for the development of rehabilitation and re-education programs for the injured, elderly and disabled. The need for modified rehabilitative wheelchairs stems from several problems faced by individuals bound to a wheelchair. A major concern for individuals who are permanently confined to a wheelchair is the potential for stiffened joints and tendons, as well as atrophy of the leg muscles. Furthermore, individuals who are temporarily confined to a wheelchair due to, for example, injury, stroke, arthritis, chronic pain, and knee or hip replacement surgery, must undergo exercise and therapeutic treatment to rehabilitate a person's unused or underused leg muscles. To alleviate this problem, those individuals confined permanently or temporarily to a wheelchair often undergo physical therapy. A typical rehabilitation patient undergoes one to two hours of rehab three days a week. However, rehab alone is insufficient and almost every patient needs to supplement their treatment on a daily basis with exercises performed outside of rehab.

Another problem faced by individuals bound to a wheelchair is the finite number of physical therapists and exercise machines present in a physical therapy or hospital facility. Even during the course of a physical therapy appointment, at any one time, a single physical therapist is assigned to a multitude of patients. As a result of the large ratio of patients to therapists, individuals who are wheelchair bound must periodically wait for personal one on one instruction by a physical therapist. Ideally, during these waiting periods, a patient will individually perform various exercises as prescribed by the therapist. However, similar to the limited number of physical therapists, a physical therapy facility or hospital also contains a limited number of exercise machines. As a result of the limited number of exercise machines compared to the number of patients at any given time, an individual often must wait until a machine becomes available. Between waiting for instruction by a physical therapist and the use of an exercise machine, the productivity and thus recovery of an individual is greatly diminished.

Although there currently exists a plurality of manually operated and motorized leg exercising devices that have been adapted as removable attachments to a wheelchair, the devices are often stationary, non-interchangeable with standard wheelchairs, structurally significant, and costly. Current leg exercising devices, in addition to having been adapted as removable attachments on a wheelchair, do not perform the basic function of a wheelchair leg rest. For example, U.S. Pat. No. 6,334,624 (Giglio) discloses a leg exerciser for the wheelchair bound including a frame which is placed on the floor. However, because the leg exerciser is structurally cumbersome and must be placed on the floor, the device is not portable.

In another example, U.S. Pat. No. 7,569,002 (Nativ) discloses a wheelchair provided with an exercise mechanism which allows a user to exercise his or her torso. In addition, the exercise mechanism also allows the user to exercise his or her legs either separately from or simultaneously with his or her torso muscle groups. However, the exercise mechanism as disclosed by Nativ is structurally integrated with the wheelchair and is thus non-interchangeable with a standard wheelchair.

In a further example, U.S. Pat. No. 8,469,866 (Hochberg et al.) discloses a wheelchair gym having a support bar releasably connected to the frame of the wheelchair, whereby leg supports for the patient's legs are attached to the opposite ends of the support bar. The leg supports may be moved up and down or may be splayed laterally. The leg supports each include an exteriorly housed hydraulic cylinder connected to the footrest. Within the hydraulic cylinder is a hydraulic piston that enables an individual to exercise his or her legs by moving each foot independently or simultaneously up and down on the leg supports in a walking or rowing manner. However, the wheelchair gym requires a support bar connected to the wheelchair of which the leg supports are subsequently connected to the wheelchair. Furthermore, because the resistance means including the hydraulic cylinder is housed on the outside of the leg supports, it can be damaged.

Lastly, U.S. Pat. No. 7,008,357 (Winkler), while not relating to a wheelchair, discloses a seat exercise device secured to a mobile platform (e.g., commercial aircraft, bus, train, automobile) for use by any passenger sitting onboard to reduce the risk of deep vein thrombosis during extended periods of travel. Although the seat exercising device includes a spring arranged between the leg support and the foot support such that a passenger may push down on the foot support to exercise his legs, the seat exercising device is not interchangeable or mountable on a wheelchair.

Therefore, there has been a long-felt need for a spring-loaded interchangeable wheelchair leg which allows a user to exercise lower extremities but still perform the same function as a typical wheelchair leg.

BRIEF SUMMARY OF THE INVENTION

The present invention broadly comprises a wheelchair leg arranged to be attached to a frame of a wheelchair comprising a first member, a bracket secured to the first member and operatively arranged to attach the first member to the frame, a second member pivotably attached to the first member, a third member arranged in telescoping engagement with the second member, and a spring located within the second member and the third member and operatively arranged to provide tension between the second and third members when the third member is moved relative to the second member.

The present invention also comprises a wheelchair leg arranged to be attached to a frame of a wheelchair comprising a first member, a bracket secured to the first member and operatively arranged to attach the first member to the frame, a second tubular member pivotably attached to the first member, a third tubular member arranged in telescoping engagement with the second tubular member, a foot rest secured at a distal end of the third tubular member, a spring located within the second and third tubular members and secured to each, the spring arranged to provide tension between the second and third tubular members when the third tubular member is moved relative to the second tubular member.

The present invention also comprises a wheelchair leg arranged to be attached to a frame of a wheelchair comprising a first tubular member, a second tubular member pivotably attached to the first member, a third tubular member arranged in telescoping engagement with the second tubular member, a bracket secured to the first tubular member and operatively arranged to attach the wheelchair leg to the frame, a footrest secured at a distal end of the third tubular member, an adjuster bar located between the first tubular member and the second tubular member, the adjuster bar operatively arranged to adjust an angle between the first and second tubular members, and a spring concentrically arranged within the second tubular member and the third tubular member to provide tension between the second and third tubular members.

A general object of the invention is to provide an individual in a wheelchair with a wheelchair leg to exercise his or her leg.

Another object of the invention is to provide an individual in a wheelchair with an interchangeable wheel chair leg to exercise his or her leg.

A further object of the invention is to provide an individual in a wheelchair with a spring-loaded interchangeable wheelchair to exercise his or her leg.

Yet another object of the invention is to manufacture a spring-loaded interchangeable wheelchair leg that is neither structurally significant nor costly.

Yet still another object of the invention is to manufacture a spring-loaded interchangeable wheelchair leg for exercising a leg that also performs the basic function of a wheelchair leg.

These and other objects, features and advantages of the present invention will become readily apparent upon a reading and review of the following detailed description of the invention, in view of the appended drawings and claims.

BRIEF DESCRIPTION OF THE DRAWINGS

The nature and mode of operation of the present invention will now be more fully described in the following detailed description of the invention in view of the accompanying figures, in which.

DETAILED DESCRIPTION OF THE INVENTION

At the outset, it should be appreciated that like drawing numbers on different drawing views identify identical, or functionally similar, structural elements of the invention. It is to be understood that the invention as claimed is not limited to the disclosed aspects.

Furthermore, it is understood that this patent is not limited to the particular methodology, materials and modifications described and, as such, may, of course, vary. It is also understood that the terminology used herein is for the purpose of describing particular aspects only, and is not intended to limit the scope of the present invention as claimed.

Unless defined otherwise, all technical and scientific terms used herein have the same meaning as commonly understood to one of ordinary skill in the art to which this invention pertains. It should be understood that any methods, devices or materials similar or equivalent to those described herein can be used in the practice or testing of the invention.

Figure 1:
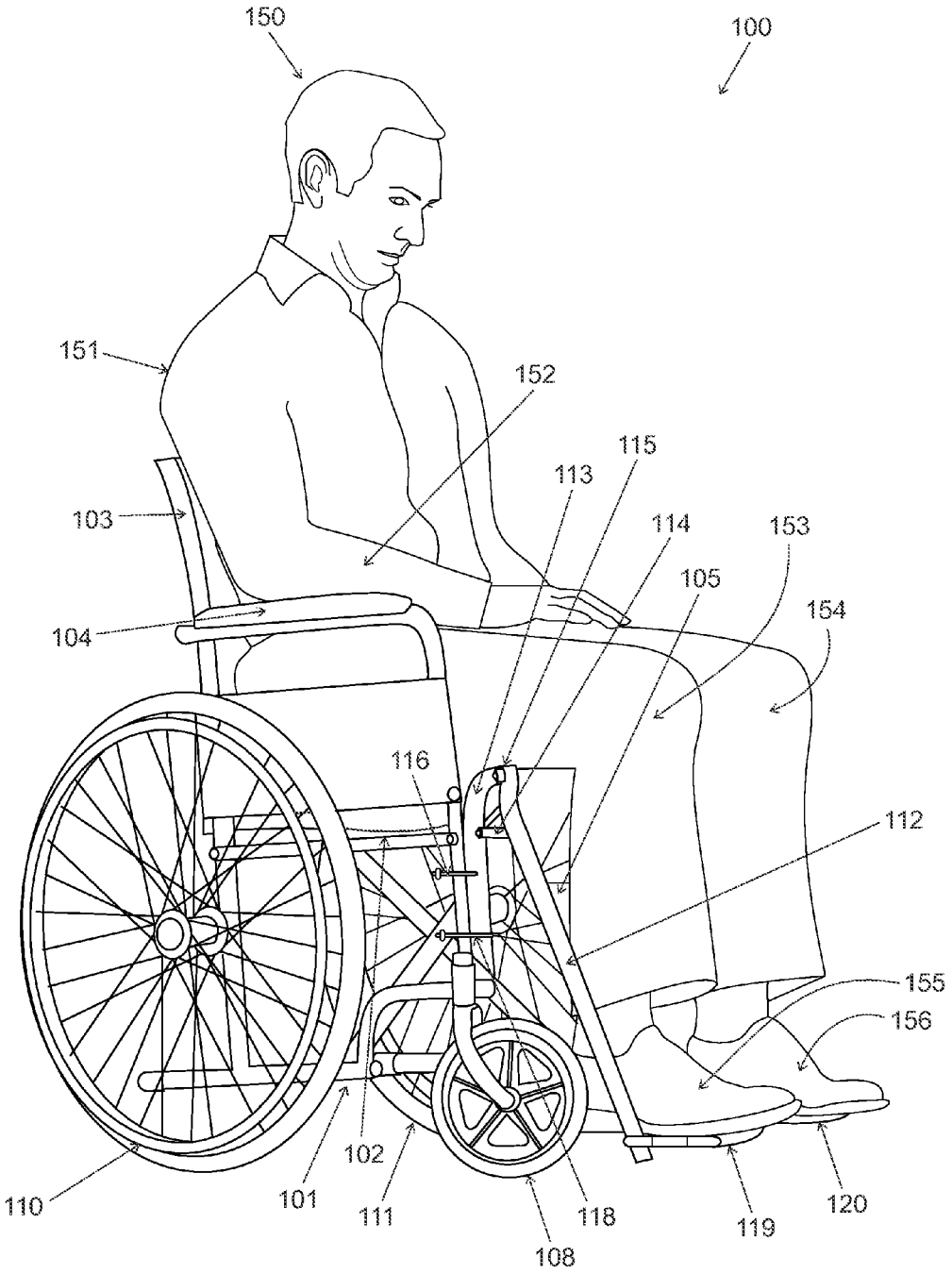
PRIOR ART Fig. 1
FIG. 1 is a perspective view of a typical wheelchair.
Figure 2:
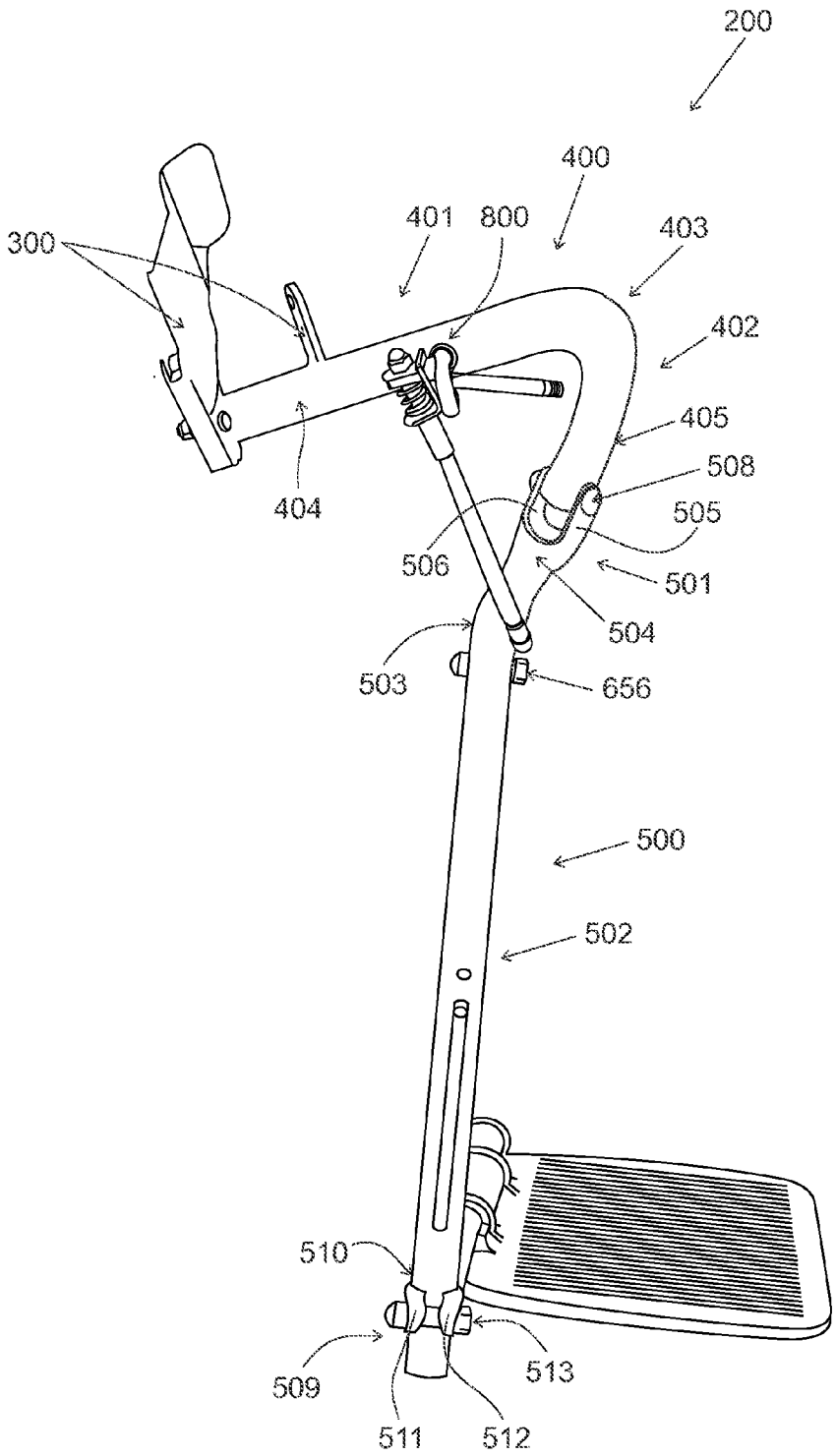
FIGS. 2, 3, and 4 are perspective views of wheelchair leg 200 of the present invention.
Figure 3:
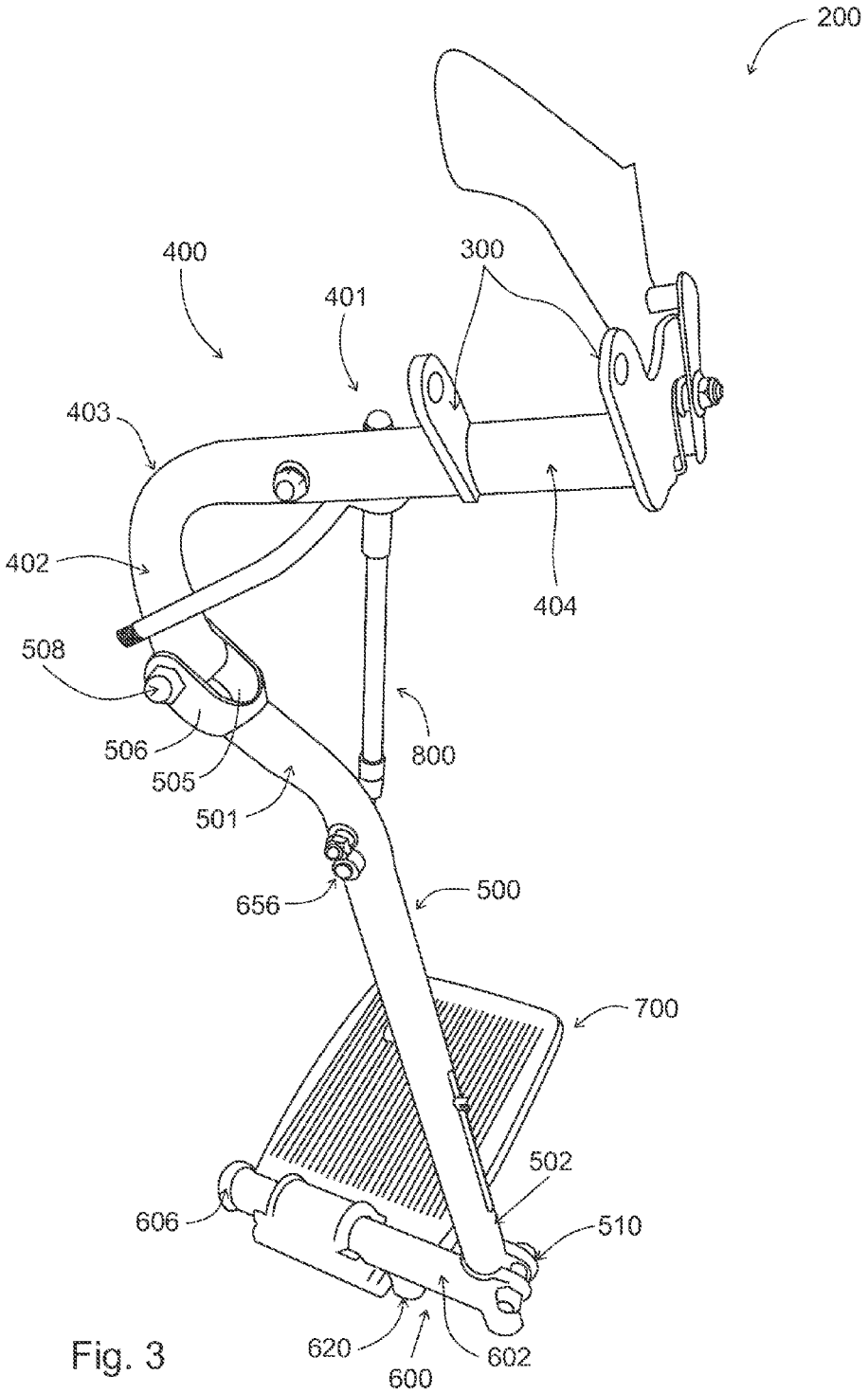
Figure 4:
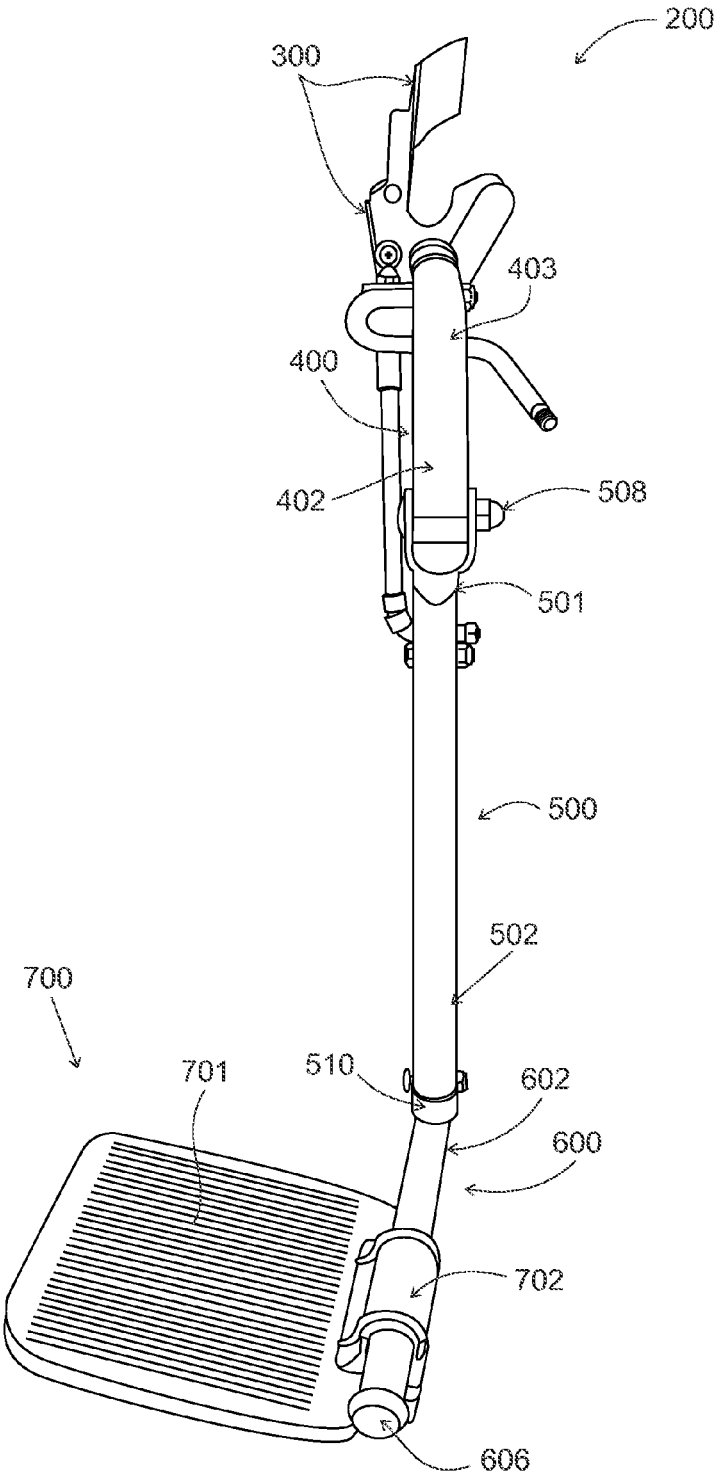

Adverting to the figures, FIGS. 2, 3, and 4 are perspective views of wheelchair leg 200 of the current invention. Wheelchair leg 200 includes bracket 300, first tubular member 400, second tubular member 500, third tubular member 600, footrest 700 and adjusting means 800.

In FIG. 2, bracket 300 is operatively arranged to attach wheelchair leg 200 to the frame of a wheelchair. At the onset, it should be appreciated that wheelchair leg 200 is interchangeable with any standard wheelchair leg and mountable to any standard wheelchair by bracket 300 which is a standard bracket and can be purchased from Ocelco Inc., located at 1111 Industrial Park Road SW, Brainerd, Minn. 56401.

As shown in the figures, first tubular member 400 and second tubular member 500 of wheel chair leg 200 can be seen. First tubular member 400 includes first tubular portion 401 and second tubular portion 402. First and second tubular portions 401 and 402 are connected by arcuate member 403, respectively. First end 404 of first tubular portion 401 is connected to bracket 300 such that first end 404 of first tubular portion 401 is co-linear with bracket 300. The second end 405 of first tubular portion 401 further includes two apertures (not shown) in registered alignment.

Second tubular member 500 includes first tubular portion 501 and second tubular portion 502. First and second tubular portions 501 and 502 are fixedly connected by arcuate member 503, respectively. First end 504 of first tubular portion 501 includes first arm 505 and second arm 506 and each further includes an aperture (not shown) in registered alignment. First and second arms 505 and 506 are fixedly connected to second end 405 of second tubular portion 402 by bolt 508 which passes through apertures (not shown) of second end 405 of first tubular member 400 and apertures (not shown) of first end 504 of second tubular member 500, respectively. Second end 509 of second tubular portion 502 of second tubular member 500 includes clamp 510 having first end 511 and second end 512. First and second ends 511 and 512 of clamp 510 each further includes an aperture (not shown) in registered alignment with bolt 513 passing through the apertures. It should be appreciated that clamp 510 secures third tubular member 600 (shown in FIG. 3) at a telescopingly determined position with respect to second tubular member 500.

In FIG. 4, footrest 700 of wheelchair leg 200 can be seen. Footrest 700 includes flat portion 701 and bracket 702 of which bracket 702 is attached to second tubular portion 602 of third tubular member 600 and flat portion 701 of footrest 700 lies perpendicularly to second tubular portion 602 of third tubular member 600. Stopper 620 (shown in FIG. 3) prevents footrest 700 from pivoting about an axis of rotation greater than 90 degrees relative to second tubular portion 602 of third tubular member 600. It should be appreciated that footrest 700 is arranged to pivot about an axis of rotation relative to second tubular portion 602 of third tubular member 600.

Figure 5:
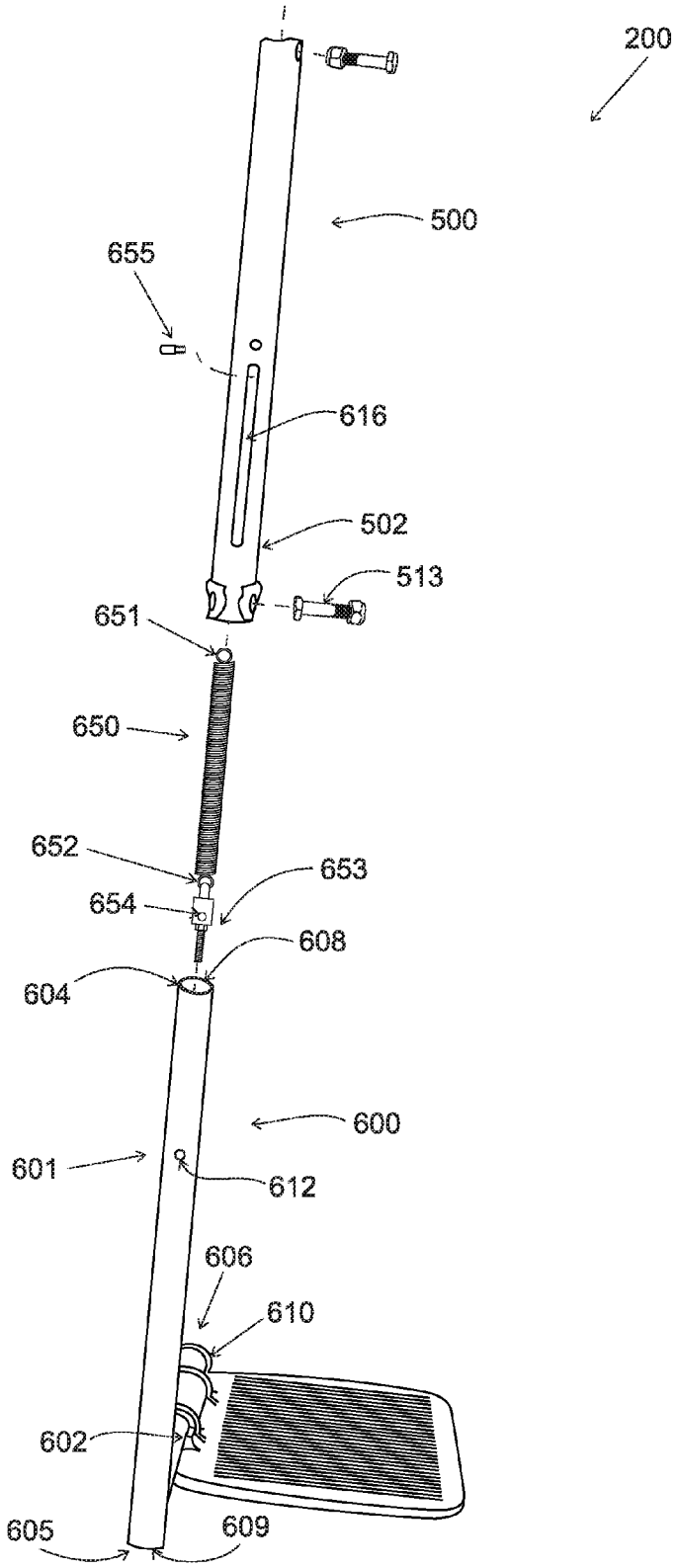
FIG. 5 is a fragmentary exploded view of wheelchair leg 200 of the present invention.

FIG. 5 is a fragmentary exploded view of wheelchair leg 200. In FIG. 5, first tubular portion 601 of third tubular member 600 of wheelchair leg 200 can be seen. Third tubular member 600 comprises first tubular portion 601 and second tubular portion 602, and stopper 620 (shown in FIG. 3). First tubular portion 601 is connected to second tubular portion 602 in perpendicular arrangement. Third tubular member 600 further includes first end 604, second end 605 and third end 606. First and second ends 604 and 605 include apertures 608 and 609, respectively and the third end 606 includes cap 610. First tubular portion 601 of third tubular member 600 further includes aperture 612. It should be appreciated that third tubular member 600 is operatively arranged to engage telescopingly with second tubular member 500 of wheelchair leg 200. Spring 650 of wheelchair leg 200 includes first loop 651, second loop 652, and block member 653 which further includes threaded screw 655 and threaded aperture 654. In an unexploded view, threaded screw 655 is connected to threaded aperture 654 of block member 653 of spring 650.

Figure 6A:
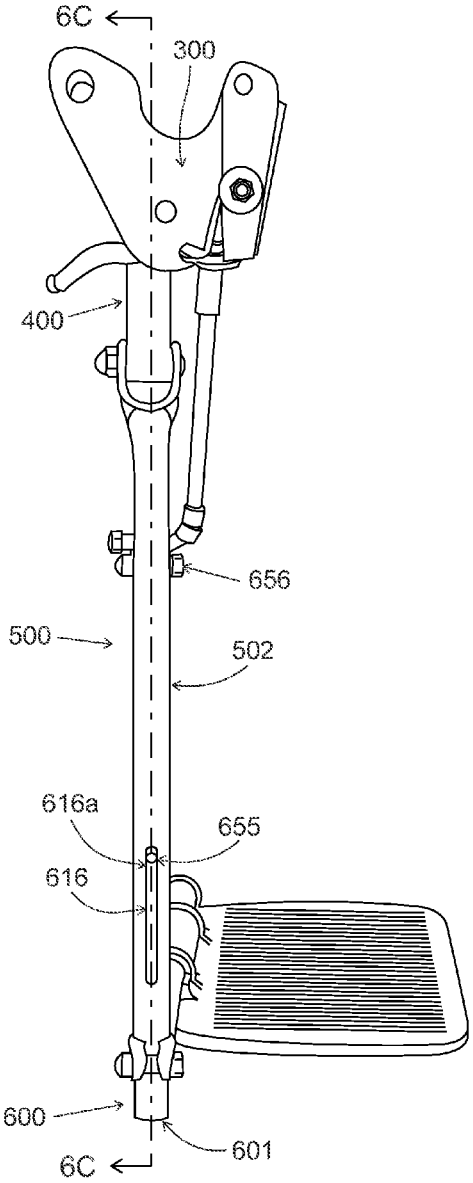
FIGS. 6A and 6B are perspective views which illustrate the telescoping engagement of second and third tubular members 500 and 600 of wheelchair leg 200 of the present invention.
Figure 6B:
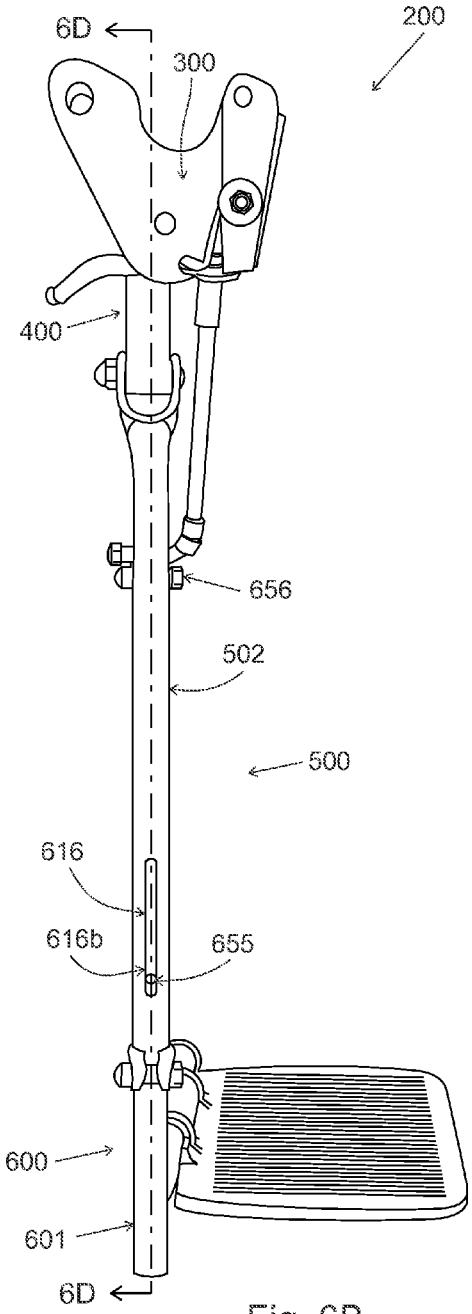

FIGS. 6A and 6B are perspective views of the telescoping engagement of second and third tubular members 500 and 600 of wheelchair leg 200. In FIG. 6A, first tubular portion 601 of third tubular member 600 is arranged at a first position within second tubular portion 502 of second tubular member 500. In the first position, first tubular portion 601 of third tubular member 600 is completely retracted within second tubular portion 502 of second tubular member 500. Threaded pin 655, which is secured to block member 653 of spring 650, is secured to aperture 612 of first tubular portion 601 of third tubular member 600 (shown in FIG. 5). Threaded pin 655, which is at first end 616*a* of aperture 616, also extends perpendicularly from aperture 616 of second tubular portion 502 of second tubular member 500.

In FIG. 6B, first tubular portion 601 of third tubular member 600 is arranged at a second position within second tubular portion 502 of second tubular member 500. In the second position, first tubular portion 601 of third tubular member 600 is completely extended with respect to second tubular portion 502 of second tubular member 500. Threaded pin 655, which is secured to block member 653 of spring 650, is operatively arranged and further secured to aperture 612 of first tubular portion 601 of third tubular member 600. Threaded pin 655, which is at the second end 616*b* of aperture 616, also extends perpendicularly from aperture 616 of second tubular portion 502 of second tubular member 500. As first tubular portion 601 of third tubular member 600 is telescopingly engaged with second tubular portion 502 of second tubular member 500 between the first and second positions, first tubular portion 601 of third tubular member 600 is guided vertically by the engagement of threaded pin 655 with aperture 616. It should be appreciated that threaded pin 655 and aperture 616 of second tubular portion 502 act as a guiding means to prevent first tubular portion 601 of third tubular member 600 from rotating about an axis of rotation while telescopingly engaged with second tubular portion 502 of second tubular member 500. It should further be appreciated that first tubular portion 601 of third tubular member 603 can be telescopingly positioned at a plurality of distances between the first and second positions.

Figure 6C:
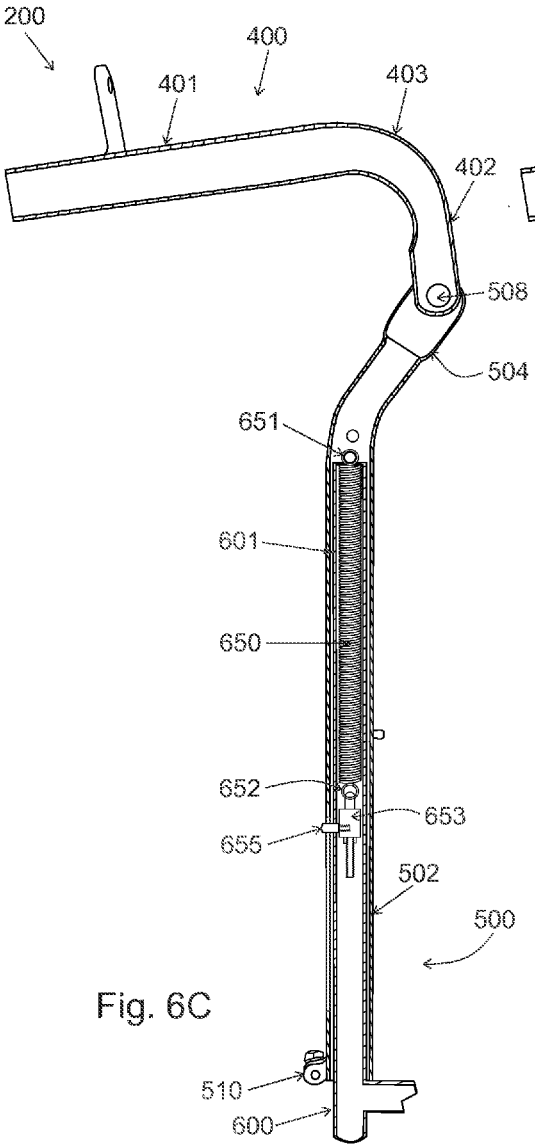
FIGS. 6C and 6D are cross sectional views of wheelchair leg 200 of the present invention in the first and second positions, respectively, taken generally along lines 6-C and 6-D in FIGS. 6A and 6B, respectively.
Figure 6D:
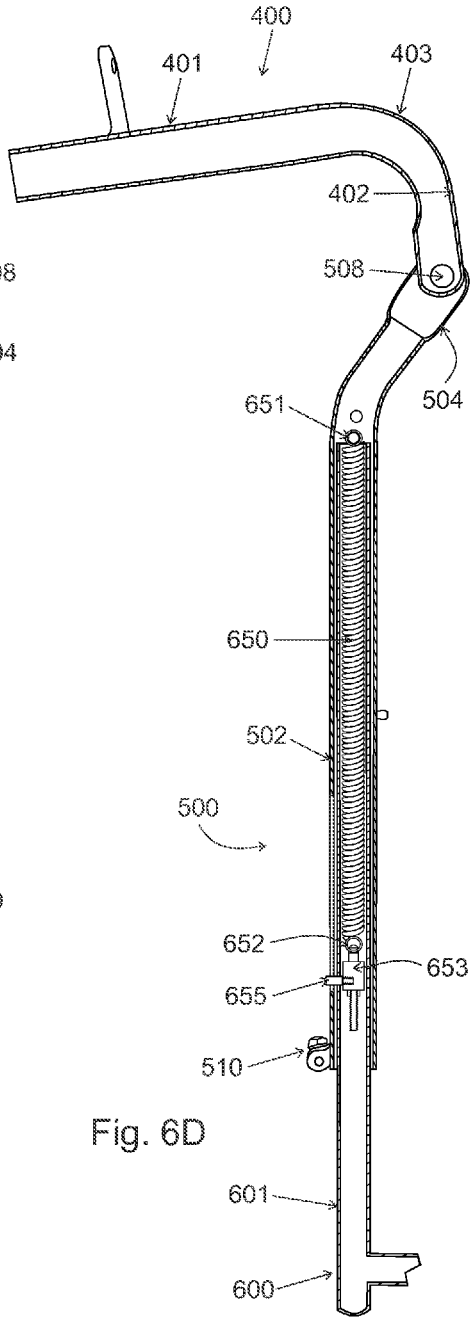

FIGS. 6C and 6D are FIGS. 6C and 6D are cross sectional views of wheelchair leg 200 in a first and second position, respectively, taken generally along lines 6-C and 6-D. In FIG. 6C, spring 650 is in the first position and is not tensioned. Additionally, in FIG. 6D, spring 650 is in the second position and is tensioned. As shown in the figures, spring 650 is arranged within second portion 502 of second tubular member 500 and first portion 601 of third tubular member 600. First loop 651 of spring 650 is arranged within second tubular portion 502 of second tubular member 500 and is attached by bolt 656 which passes through first loop 651 and engages with second portion 502 of second tubular member 500. Second loop 652 of spring 650 is fixedly secured to block member 653. Block member 653 is arranged within first tubular portion 601 of third tubular member 600 and attached by threaded pin 655 which is fastened to aperture 654 (shown in FIG. 5) of block member 653 and aperture 612 of first tubular portion of 601 of third tubular member 600, respectively. Threaded pin 655 also extends perpendicularly from aperture 616 of second tubular portion 502 of second tubular member 500.

Figures 7A, 7B:
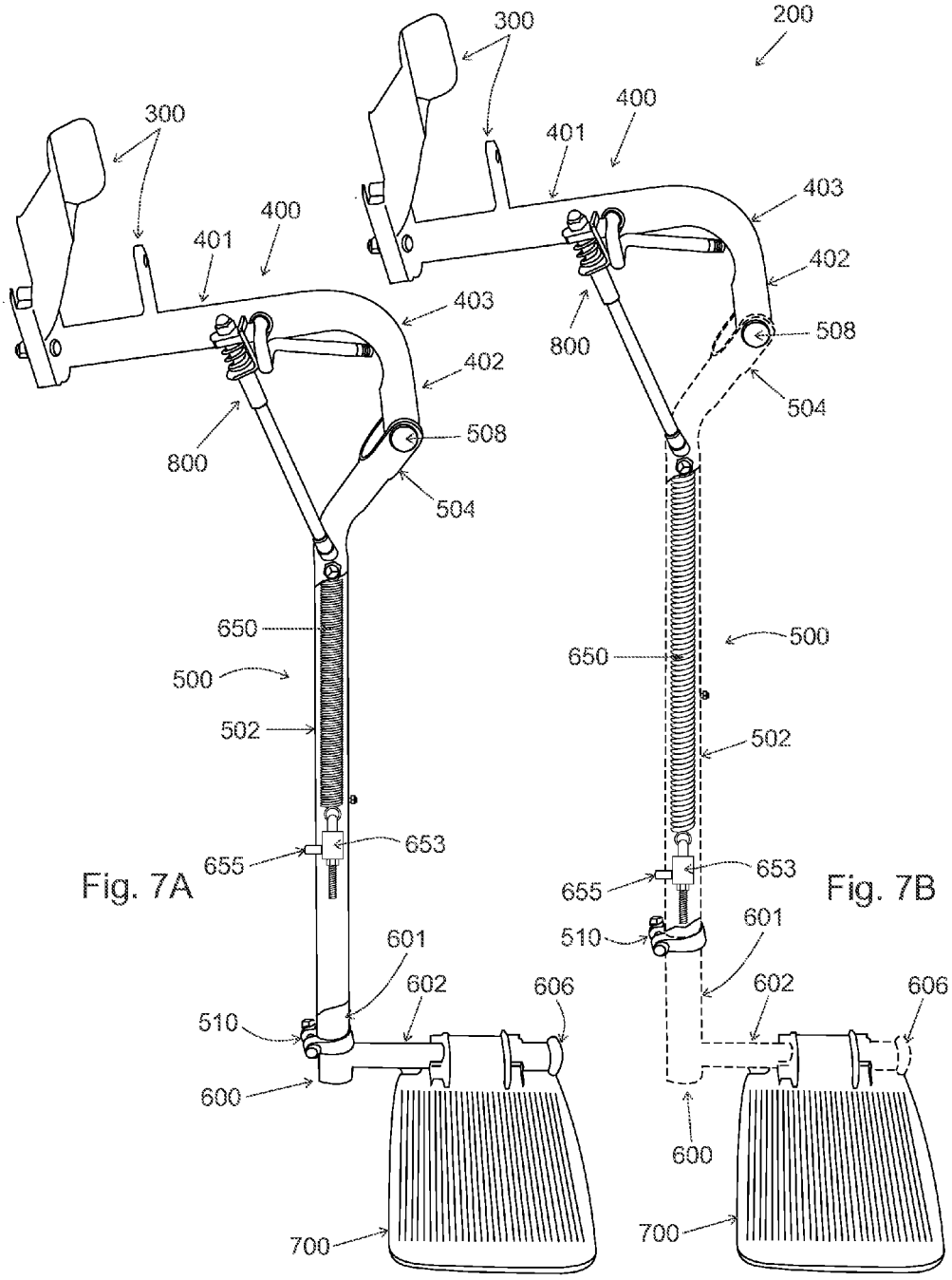
FIGS. 7A and 7B are fragmented cross sectional views of wheelchair leg 200 of the present invention; and, FIG. 8 is a partial perspective view of first tubular portion 501 of second tubular member 500 at a first position and a second position.

FIGS. 7A and 7B are fragmented cross sectional views of wheelchair leg 200. In FIG. 7A, first tubular portion 601 of third tubular member 600 is arranged at a first position with respect to second tubular portion 502 of second tubular member 500. In the first position, footrest 700 of wheelchair leg 200 is in a disengaged state and first tubular portion 601 of third tubular member 600 is completely telescopingly retracted with respect to second tubular portion 502 of second tubular member 500 due to a user not pushing down on footrest 700. Spring 650 is not in tension and is arranged between second portion 502 of second tubular member 500 and first portion 601 of third tubular member 600. Threaded pin 655, which is secured to block member 653 of spring 650, is secured to aperture 612 (shown in FIG. 6*a*) of first tubular portion 601 of third tubular member 600. Threaded pin 655, which is at the first end 616*a* of aperture 616, also extends perpendicularly from aperture 616 of second tubular portion 502 of second tubular member 500.

In FIG. 7B, first tubular portion 601 of third tubular member 600 is arranged at a second position with respect to second tubular portion 502 of second tubular member 500. In the second position, there is an applied force acting upon footrest 700 of wheelchair leg 200 and first tubular portion 601 of third tubular member 600 is completely telescopingly retracted with respect to second tubular portion 502 of second tubular member 500 due to an applied force on footrest 700 in order to expand and spring 650. In the second position, spring 650 is tensioned and arranged between second portion 502 of second tubular member 500 and first portion 601 of third tubular member 600. Threaded pin 655, which is secured to block member 653 of spring 650, is secured to aperture 612 (shown in FIG. 6*a*) of first tubular portion 601 of third tubular member 600. Threaded pin 655, which is positioned at the second end 616*b* of aperture 616 (shown in FIG. 6B), also extends perpendicularly from aperture 616 of second tubular portion 502 of second tubular member 500.

As third tubular member 600 extends telescopingly with respect to second tubular member 500, the tension in spring 650 correspondingly increases such that spring 650 becomes spring biased vertically. Conversely, as third tubular member 600 retracts telescopingly with respect to second tubular member 500, the tension in spring 650 correspondingly decreases. It should be appreciated that when footrest 700 is in an engaged or disengaged state between the first and second positions, the tension of spring 650 increases and decreases, respectively. It should be further appreciated that when footrest 700 is in an engaged or disengaged state between the first and second portions, the position of threaded pin 655 changes vertically and thereby prevents third tubular member 600 from rotating about an axis of rotation when telescopingly engaged with second tubular member 500.

Figure 8:
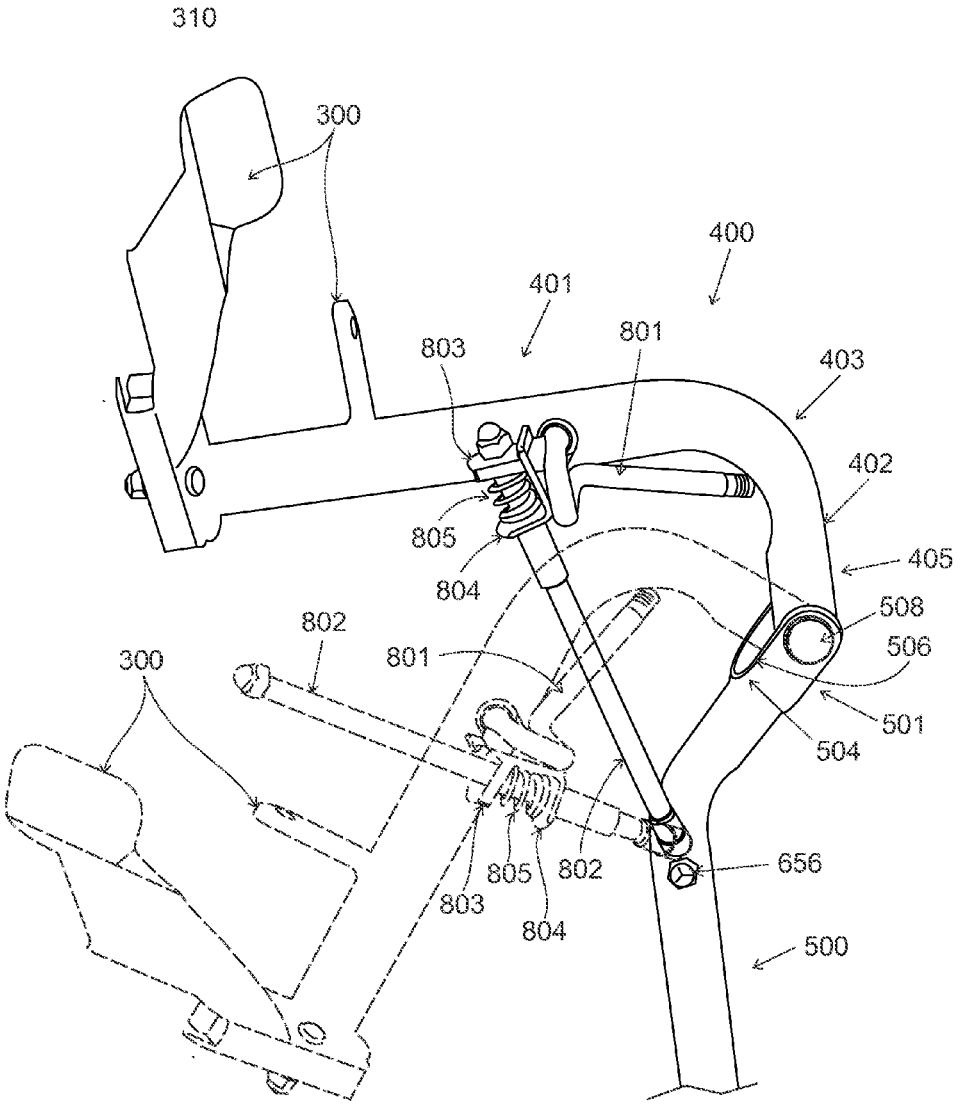

FIG. 8 is a partial perspective view of second tubular member at a first position (shown in solid lines) and a second position (shown in broken lines). At the onset, it should be appreciated that second tubular member 500 is operably arranged to pivot about an axis of rotation relative to first tubular member 400 and between a first position and a second position. It should be further appreciated that wheel chair leg 200 includes an adjusting locking means 800 operably arranged to adjust second tubular member 500 from a first locked position to a second locked position. In the first position, wheelchair leg 200 is attached to a wheelchair by bracket 300. Second tubular member 500 lies perpendicular to first tubular member 400 and is extended at its furthermost position. Adjusting and locking means 800 is secured and operably arranged between first tubular member 400 and second tubular member 500. Adjusting and locking means 800 further includes first rod 801, second rod 802, first bracket 803, second bracket 804, and spring 805. First rod 801 is arranged on first tubular portion 401 of first tubular member 400. Additionally, second rod 802 is arranged on second tubular portion 501 of second tubular member 500.

For second tubular member 500 to pivot about and axis of rotation relative to first tubular member 400, a user pushes first rod 801 toward first tubular portion 401 of first tubular member 400. As first rod 801 is engaged toward first tubular portion 401, first rod 801 pivots on first tubular portion 401 of first tubular member 400. As first rod 801 pivots, second bracket 804, which is secured to first rod 801, is engaged such that the angle of second bracket 804 is decreased relative to second rod 802. As the angle of second bracket 804 is decreased relative to second rod 802, the tension in spring 805 is increased. As second tubular member 500 pivots about an axis of rotation relative to first tubular member 400, second rod 802 is slidingly engaged between first and second brackets 803 and 804, respectively. In the second position, second tubular member 500 is retracted at its closest position from a wheelchair frame. It should be appreciated that second tubular member 500 can be operably arranged at any position with respect to the first position and second position. Once second tubular member 500 is at a desired position, first rod 801 is disengaged causing spring 805 to apply a force to first bracket 803 and second bracket 804 and to return first rod 801 back to its original position. The force applied by spring 805 to first bracket 803 and second bracket 804 causes the angle of second bracket 804 to increase with respect to first rod 801. The increase in the angle of second bracket 804 with respect to second rod 802 thus locks second tubular member 500 at a fixed position. It should be appreciated that second tubular portion 502 of second tubular member 500 is operably arranged to pivot about an axis of rotation relative to first tubular portion 401 of first tubular member 400.

It will be appreciated that various features of the above-disclosed invention and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMBERS

100 wheelchair assembly
101 frame
102 seat
103 backrest
104 armrest
105 leg
108 front wheel
109 front wheel
110 rear wheel
111 rear wheel
112 first member
113 second member
114 third member
115 bolt
116 bolt
118 bolt
119 right footrest
120 left footrest
150 individual
151 back
152 arm
153 leg
154 leg
155 foot
156 foot
200 wheelchair leg
300 bracket
400 first tubular member
401 first tubular portion
402 second tubular portion
403 arcuate member

404 first end
405 second end
500 second tubular member
501 first tubular portion
502 second tubular portion
503 arcuate member
504 first end
505 first arm
506 second arm
508 bolt
509 second end
510 clamp
511 first end
512 second end
600 third tubular member
601 first tubular portion
602 second tubular portion
604 first end
605 second end
606 third end
608 aperture
609 aperture
610 cap
612 aperture
616 aperture
616*a* first end
616*b* second end
620 stopper
650 spring
651 first loop
652 second loop
653 block member
654 threaded aperture
655 threaded screw
656 bolt
700 footrest
701 flat portion
702 bracket
800 adjusting and locking means
801 first rod
802 second rod
803 first bracket
804 second bracket
805 spring

What is claimed is:

1. A wheelchair leg arranged to be attached to a frame of a wheelchair, comprising:

a first member;

a bracket secured to said first member, said bracket operatively arranged to attach said first member to said frame;

a second member pivotably attached to said first member;

a third member arranged in telescoping engagement with said second member;

said second member comprising a guiding means; and a spring located within said second member and said third member operatively arranged to provide tension between said second and third members when said third member is moved relative to said second member;

wherein said spring includes a first end and a second end, said first end of said spring is attached to said second member and said second end of said spring is secured to said third member, wherein said second end of said spring is further connected to a pin fixedly connected to said third member; wherein said pin is operatively engaged with said guiding means in said second member to prevent said third member from rotating about an axis of rotation while telescopically engaged with said second member, wherein said second end of said spring is affixed to a block and said pin is directly secured to said block.

2. The wheelchair leg as recited in claim 1, further comprising an adjuster bar, located between said first member and said second member, said adjuster bar operatively arranged to adjust an angle along an axis of rotation between said first and second members.

3. The wheelchair leg as recited in claim 2, wherein said adjuster bar comprises a locking mechanism operatively arranged to lock said second member along the axis of rotation with respect to said first member.

4. The wheelchair leg as recited in claim 1, further comprising a footrest operatively arranged at a distal end of said third member.

5. The wheelchair leg as recited in claim 4, wherein said third member comprises a first section and a second section, said first section is perpendicular to said second section and telescopingly engaged with said second member.

6. The wheelchair leg as recited in claim 5, wherein said footrest is arranged perpendicular to said second section of said third member.

7. The wheelchair leg as recited in claim 1, wherein said third member comprises said pin fixedly connected thereon and said second member guiding means comprises an aperture arranged thereon, said pin engages said aperture and prevents said third member from rotating with respect to said second member.

8. The wheelchair leg as recited in claim 7, wherein said pin lies perpendicular to said aperture, said pin further extending through said aperture.

9. A wheelchair leg arranged to be attached to a frame of a wheelchair, comprising:

a first member;

a bracket secured to said first member, said bracket operatively arranged to attach said first member to said frame;

a second tubular member pivotably attached to said first member, said second tubular member comprising a guiding means;

a third tubular member arranged in telescoping engagement with said second tubular member;

a foot rest secured at a distal end of said third tubular member;

a spring located within said second and third tubular members and secured to each of said second and third tubular members, said spring arranged to provide tension between said second and third tubular members when said third tubular member is moved relative to said second tubular member;

wherein said spring includes a first end and a second end, said first end of said spring is attached to said second tubular member and said second end of said spring is secured to said third tubular member, wherein said second end of said spring is further connected to a pin fixedly connected to said third tubular member; wherein said pin is operatively engaged with said guiding means in said second tubular member to prevent said third tubular member from rotating about an axis of rotation while telescopically engaged with said second tubular member, wherein said second end of said spring is affixed to a block and said pin is directly secured to said block.

10. The wheelchair leg as recited in claim 9, further comprising an adjuster bar, located between said first member and said second tubular member, said adjuster bar operatively arranged to adjust an angle along an axis of rotation between said first member and said second tubular member.

11. The wheelchair leg as recited in claim 10, wherein said adjuster bar comprises a locking mechanism operatively arranged to lock said second tubular member along the axis of rotation with respect to said first member.

12. The wheelchair leg as recited in claim 9, wherein said third tubular member comprises a first section and a second section, said first section is perpendicular to said second section and telescopingly engaged with said second tubular member.

13. The wheelchair leg as recited in claim 12, wherein said footrest is arranged perpendicular to said second section of said third tubular member.

14. The wheelchair leg as recited in claim 9, wherein said third tubular member comprises a pin fixedly connected thereon and said second tubular member comprises an aperture arranged thereon, said pin engages said aperture and prevents said third tubular member from rotating with respect to said second tubular member.

15. The wheelchair leg as recited in claim 14, wherein said pin lies perpendicular to said aperture, said pin further extending through said aperture.

16. A wheelchair leg arranged to be attached to a frame of a wheelchair, comprising:

a first tubular member;

a second tubular member pivotably attached to said first tubular member, said second tubular member comprising a guiding means;

a third tubular member arranged in telescoping engagement with said second tubular member;

a bracket secured to said first tubular member and arranged to attach said wheelchair leg to said frame;

a footrest secured at a distal end of said third tubular member;

an adjuster bar, located between said first tubular member and said second tubular member, said adjuster bar operatively arranged to adjust an angle between said first and second tubular members; and, a spring concentrically arranged within said second tubular member and said third tubular member to provide tension between said second and third tubular members;

wherein said spring includes a first end and a second end, said first end of said spring is attached to said second tubular member and said second end of said spring is secured to said third tubular member, wherein said second end of said spring is further connected to a pin fixedly connected to said third tubular member; wherein said pin is operatively engaged with said guiding means in said second tubular member to prevent said third tubular member from rotating about an axis of rotation while telescopically engaged with said second tubular member, wherein said second end of said spring is affixed to a block and said pin is directly secured to said block.

* * * * *